United States Patent [19]

Wischusen, III et al.

[11] Patent Number: 4,676,430

[45] Date of Patent: Jun. 30, 1987

[54] END-LOAD TOP-DISPENSING CONTAINER WITH TUCK CLOSURE

[75] Inventors: Henry Wischusen, III, Lilburn, Ga.; Richard J. Fletcher, Wilmington, Del.

[73] Assignees: E. I. Du Pont de Nemours & Co., Wilmington, Del.; Rock-Tenn Company, Norcross, Ga.

[21] Appl. No.: 778,870

[22] Filed: Sep. 23, 1985

Related U.S. Application Data

[63] Continuation-in-part of Ser. No. 558,030, Dec. 5, 1983, Pat. No. 4,550,834.

[51] Int. Cl.[4] ..... B65D 5/08

[52] U.S. Cl. ..... 229/140; 206/620; 206/628; 206/634; 229/141; 229/153; 229/177; 229/188

[58] Field of Search ..... 229/138, 140, 141, 151, 229/152, 153, 171, 177, 188, 904; 206/561–565, 607, 620, 628, 634

[56] References Cited

U.S. PATENT DOCUMENTS

| | | | |
|---|---|---|---|
| D. 134,249 | 11/1942 | Button | 206/564 |
| 665,556 | 1/1901 | Webb | 229/151 |
| 1,111,552 | 9/1914 | Allers | 229/151 |
| 2,512,963 | 6/1950 | Peiker | 206/563 |
| 2,889,102 | 6/1959 | Wagaman | 229/188 |
| 2,928,581 | 3/1960 | Graybill | 229/138 |
| 3,253,769 | 5/1966 | Opber | 229/153 |
| 3,690,543 | 9/1972 | Zeitter | 229/117 |
| 3,729,127 | 4/1973 | Kleinhaut | 229/138 |
| 4,307,834 | 12/1981 | Roccatorte | 229/138 |
| 4,511,042 | 4/1985 | Wischusen, III | 229/904 |

FOREIGN PATENT DOCUMENTS

| | | | |
|---|---|---|---|
| 2924302 | 12/1980 | Fed. Rep. of Germany | 229/152 |
| 1129223 | 9/1956 | France | 206/625 |

*Primary Examiner*—Stephen Marcus
*Assistant Examiner*—Gary E. Elkins
*Attorney, Agent, or Firm*—Jones & Askew

[57] ABSTRACT

A self-erecting end-loading top-dispensing container which is convertible from a substantially flattened configuration for shipping the empty container into an erected box-like configuration for loading product into the container and for shipping loaded containers. By removing a tear-away portion of the top panel, the container is convertible into a tray having an open top for dispensing product. Connecting webs join the end closures of the container to the front and rear side walls; preserving the structural integrity of the container when the removable top is torn away.

10 Claims, 11 Drawing Figures

Fig. 2
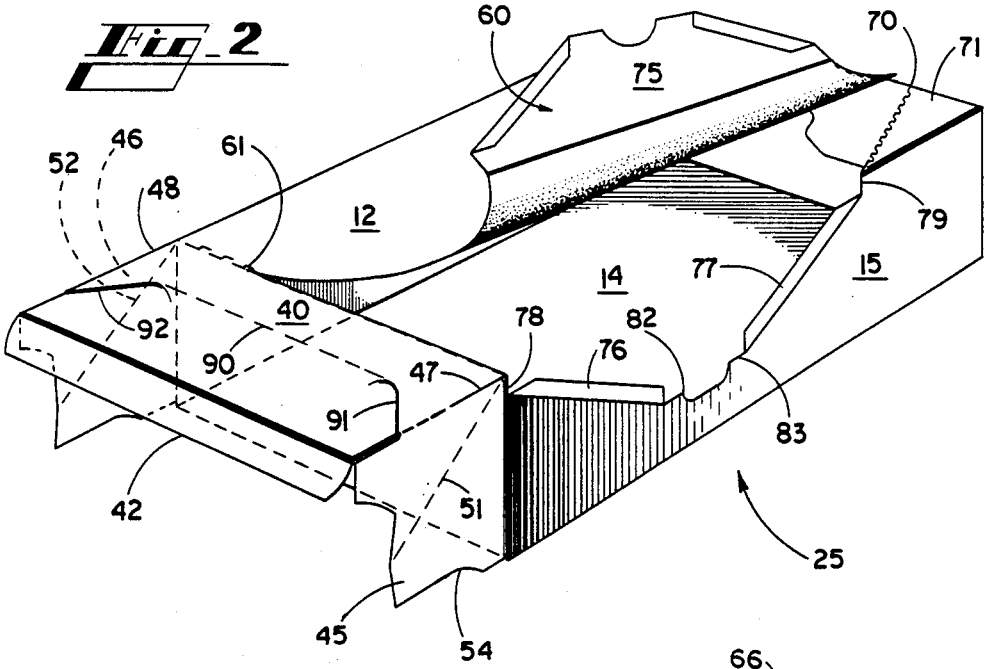
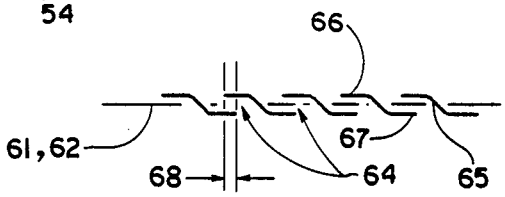
Fig. 6
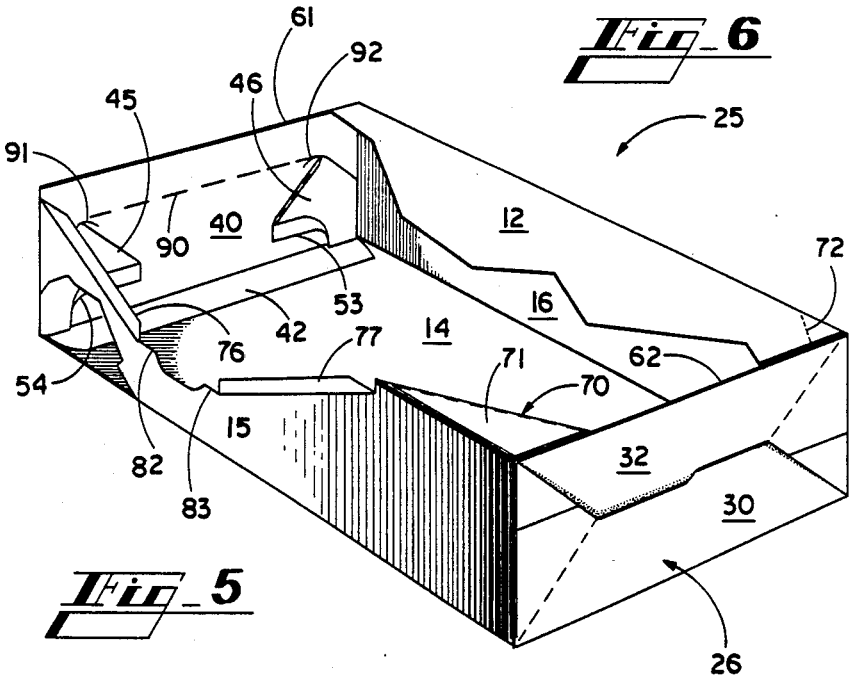
Fig. 5

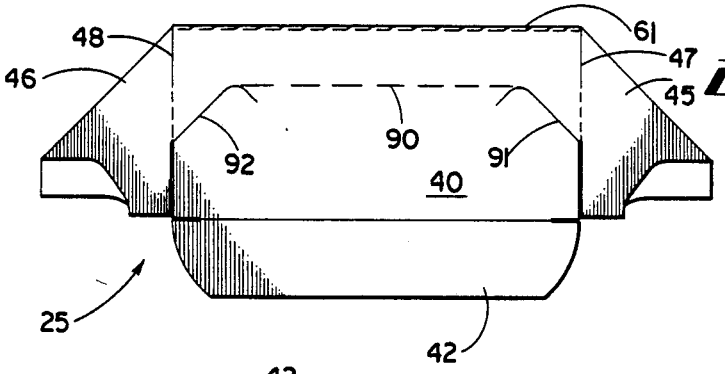
Fig. 7
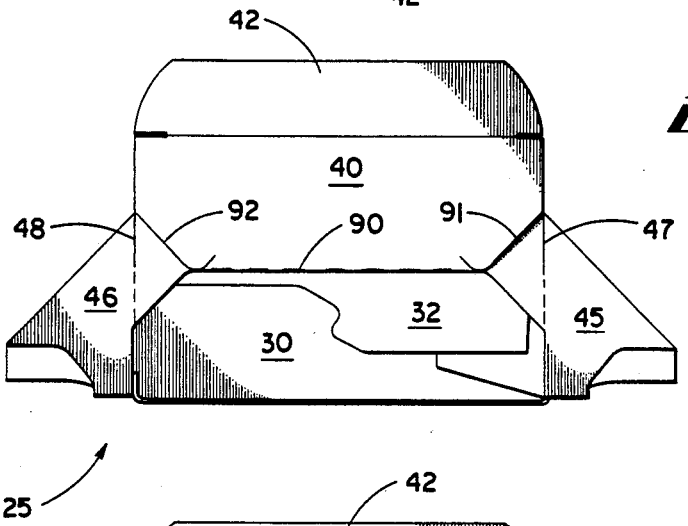
Fig. 8
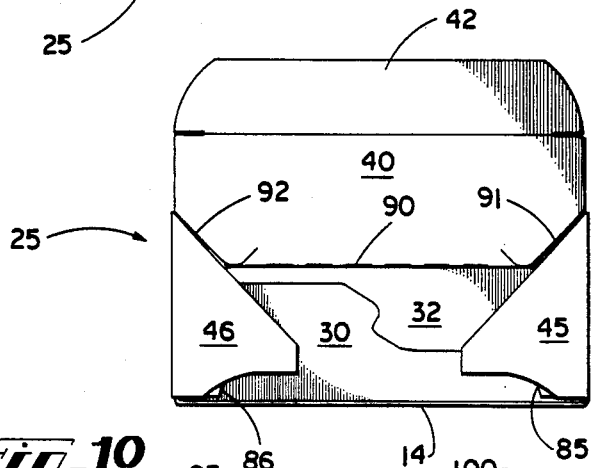
Fig. 9
Fig. 10
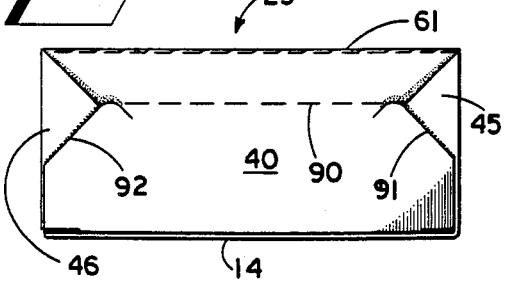
Fig. 11
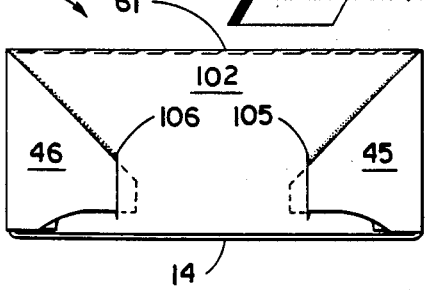

END-LOAD TOP-DISPENSING CONTAINER WITH TUCK CLOSURE

CROSS REFERENCE TO RELATED APPLICATION

The present application is a continuation-in-part of U.S. application Ser. No. 558,030, filed Dec. 5, 1983, now U.S. Pat. No. 4,550,834 issued 11-5-85.

TECHNICAL FIELD

The present invention relates generally to disposable containers formed from a single sheet of paperboard or the like, and particularly relates to a container which is shipped in a flattened configuration, erected into a box-like configuration for loading product into the container and for shipping loaded containers, and is convertible into a tray having an open top for dispensing product.

BACKGROUND ART

Many attempts have been made in the packaging industry to provide customers with convenient containers which are easy and economical to ship prior to loading, and which when loaded with product allow convenient dispensing of product carried by the container. In the health services and medical professions, there is often a need to dispense medical goods in small stackable trays, each tray carrying the items needed for one patient. For example, small plastic trays carrying a syringe, a cleaning swab, and a drug may be stacked several trays high and shipped as a unit by the manufacturer of the medical goods. A zippered score allows a portion of the container to be removed to grasp the trays one at a time for use with an individual patient.

Typically, dispensers for these products have end closure which are glued once the stack of product trays is loaded into the container. The use of end closures which are glued unfortunately requires that the empty containers be assembled and glued at the manufacturers facilities after the containers are loaded, thereby requiring an investment in containererecting equipment.

Designs for containers which include end closures which are not glued but consist of tuck flaps at either end solve the problem of the need for container-erecting equipment, but these type containers cannot reliably include a tear-away portion of the container. Tearing away a removable portion of a tuck-flap type container in order to allow dispensing product results in an unstable container which simply falls apart and does not function to hold together the supply of product trays.

In our prior related application identified above, we disclosed a container which overcame the problems in the art and provided an end-loading container that is closed for shipping without gluing and becomes a top-dispensing container by tearing away the top panel. Although this provided a serviceable and commercially successful container, it has been found that overly aggressive users may exert enough outward pressure on the tuck-in closure end panel of the container to cause the dust flaps to tear away from the side panels.

SUMMARY OF THE INVENTION

The present invention provides a further improved end-loading, top-dispensing container that is more resistant to tearing after the top panel has been removed. This is accomplished by a special tuck-in closure and dust flap construction according to which the end panel is partially interposed between the dust flaps and the contents of the container.

Generally described, the present invention provides a sleeve-like container of paperboard or the like comprising a top panel; a bottom panel; first and second side panels connecting the top and bottom panels; an end panel foldably connected to the top panel; a pair of webs extending between the end panel and each of the side panels, each of the webs including a diagonal score line extending from the intersection of the end panel and the adjoining side panel for folding the web; and slit means in the end panel for receiving the folded webs when the end panel is closed.

The container preferably further comprises a tuck flap foldably connected to the end panel opposite the top panel, and the webs end prior to the tuck flap, leaving free edges of the end panel. The slit means comprises a cut line extending from each free edge of the end panel into the end panel to a location beyond the diagonal score line when the folded webs are folded into the plane of the end panel.

The end panel preferably includes a horizontal score line parallel to the foldable connection of the end panel to the top panel; and each cut line extends, from a point on the free edge of the end panel between the horizontal score line and the tuck flap, diagonally to meet the horizontal score line. The horizontal fold line terminates at its intersection with each of the cut lines, which, after meeting the horizontal score line, curve back toward the tuck flap.

The slit means can alternately comprise a pair of slits lying generally perpendicular to the connection between the top panel and the end panel and spaced inwardly from the webs, for receiving the ends of the folded webs.

The present invention also provides a cut and scored blank of paperboard or like material for forming a sleeve-like container, comprising a top panel; first and second side panels foldably connected to the top panel; a bottom panel foldably connected to the first side panel opposite the top panel; an end panel foldably connected to one of the top and bottom panels; a pair of webs of the material extending between the end panel and each of the side panels, each of the webs including a diagonal score line extending from the intersection of the end panel and the adjoining side panel for folding the web; and slit means in the end panel for receiving the folded webs when the container is erected and the end panel is closed.

Thus, it is an object of the present invention to provide a self-erecting end-loading, top-dispensing container.

It is a further object of the present invention to provide a container including an improved end panel construction in which the dust flaps cooperate with the end panel to strengthen the container.

It is a further object of the present invention to provide an end panel construction that tends to relieve tearing stress on the end panel construction.

It is a further object of the present invention to provide a container having a tuck-in closure according to which the dust flaps are disposed primarily outside the end panel.

It is a further object of the present invention to provide a container which is convertible from a substantially flattened configuration for shipping the empty containers into an erected box-like configuration for loading product into the container and for shipping loaded containers without gluing, and which is further convertible into a tray having an open top for dispensing product.

It is a further object of the present invention to provide an end-loading, top-dispensing container wherein a portion of the top of the container is removed to allow dispensing of a product, and wherein the end closures of the container are joined to the side walls of the container for maintaining the structural integrity of container when the removable portion of the top panel is removed for dispensing of a product.

Other objects, features and advantages of the present invention will become apparent upon reading the following detailed description of a preferred embodiment of the invention, when taken in conjunction with the drawings and the appended claims.

BRIEF DESCRIPTION OF THE DRAWINGS

FIG. 2 is a pictorial view of a container embodying the present invention in its erected configuration, showing a portion of the top of the container being partially removed.

FIG. 5 is a pictorial view of the container shown in FIG. 2 with a portion broken away to show interior detail, and showing the resultant tray with the portion of the top panel removed.

FIG. 6 is a detailed view of the tear score line employed in the preferred embodiment for removal of a portion of the top of the container.

FIGS. 7–10 are end views of the container showing the sequence of steps for closing the tuck-in closure.

FIG. 11 is an end view of an alternate embodiment of the tuck-in closure.

DETAILED DESCRIPTION

Figure 1:
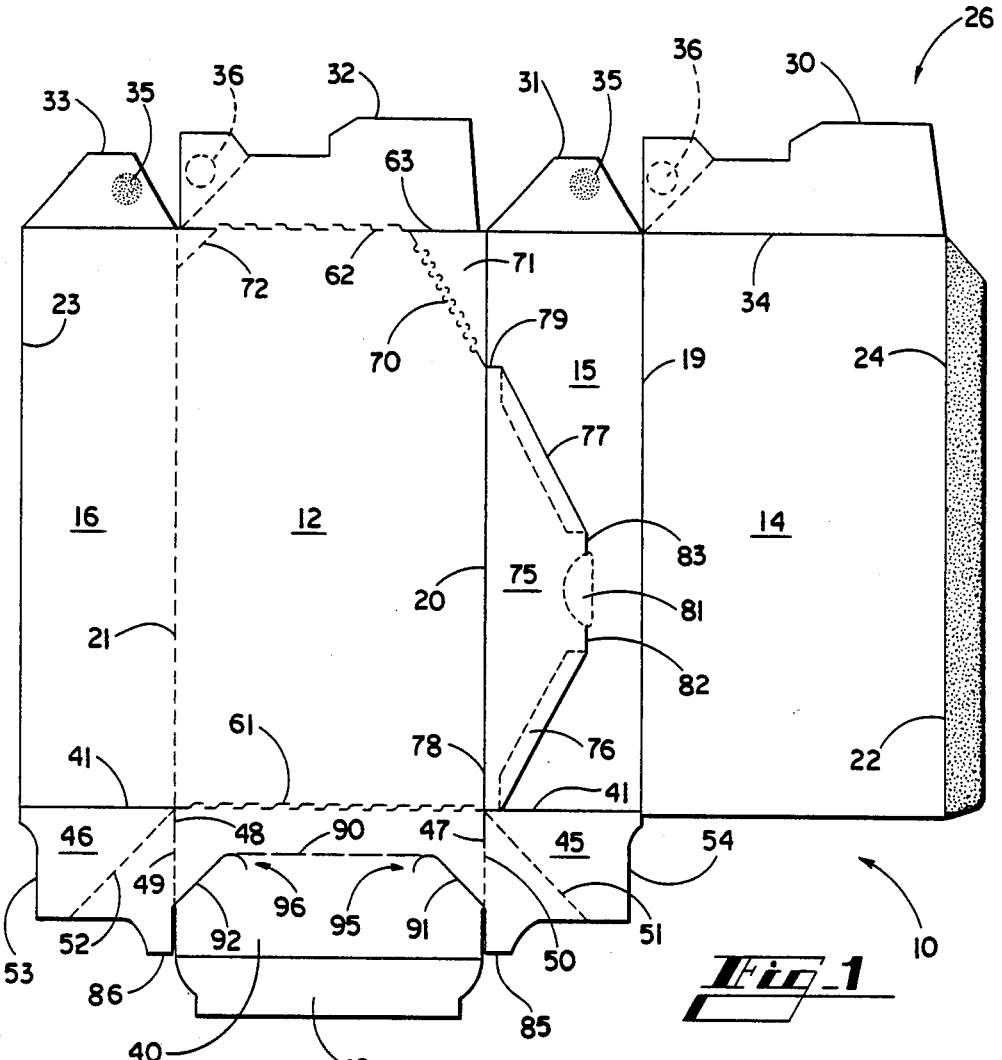
FIG. 1 is an outside plan view of a paperboard blank from which the container of the present invention is assembled.

Referring now in more detail to the drawings, in which like reference numerals represent like parts through out the several views, FIG. 1 shows a paperboard blank 10 which is assembled to construct the container of the present invention. The blank 10 is cut and scored from paperboard or the like.

The blank 10 includes a top panel 12, a bottom panel 14, a front or first side wall member or panel 15, and a rear or second side wall member or panel 16. The top or first panel member 12 is substantially rectangular, and is hingedly connected along a transverse score line 20 to the front side wall 15. The top panel is hingedly connected at another transverse score line 21 to the rear side wall 16. A glue flap 22 is hingedly connected at still another transverse score line 24 to permit securing the bottom panel 14 to the rear side wall 16.

Referring to FIGS. 2 and 5, it is seen that the side walls 15, 16 hold the top and bottom panels in spaced-apart relation, and a rectangular tubular enclosure is formed when a cut edge 23 of the rear side wall 16 is adhered to the glue flap 22.

Preferably, the transverse score line 21 connecting the top panel 12 and the rear side wall 16 is a jump cut score which allows removal of the top panel in a manner described below.

As best seen in FIG. 5, the completed and erected container 25 has a closed end indicated generally at 26, which is closed by flap means forming a conventional "automatic end closure." In FIG. 1, the automatic end closure 26 is seen to comprise an end flap 30 foldably connected to the bottom panel 14, an end flap 31 foldably connected to the front side wall 15, an end flap 32 foldably connected to the top panel 12, and an end flap 33 foldably connected to the rear side wall 16, all of the end flaps 30–33 being connected along a collinear longitudinal score line 34.

Glue spots 35 are applied to the end flaps 31 and 33 on the outside of the blank 10, and adhere to the areas 36 shown in dotted relief in FIG. 1 on the end flaps 30, 32, for creating the automatic end closure. When the container 25 is erected, the end flaps 30 and 32 interlock in a conventional manner, as shown in FIG. 5, to provide rigidity to the automatic end closure.

Referring again to FIG. 1, to a tuck-in closure is provided including an end wall flap or end panel hingedly connected along a longitudinal line 41 to the top panel 12. The end wall flap includes a conventional tuck flap 42 for inserting into the erected container, creating an openable and closable product insertion opening in the erected container.

The end wall flap 40 is connected to the front side wall 15 and the rear side wall 16 via connecting webs or dust flaps 45, 46, respectively. The dust flap 46 is connected to the end wall flap 40 along a part of the transverse score line 21, while the dust flap 45 is connected to the end wall flap along an extension of the transverse score line 20. These connections are shown at 47 and 48, respectively. The middle portions of end panel 40 and dust flaps 45, 46 are connected by perforated scores 49, 50, whereas the remaining outer portions are cut, providing free side edges of the end panel 40. Accordingly, the front and rear side panels 15, 16 remain connected to the end wall flap 40 after the removable portion of the top panel 12 is torn away, thereby maintaining the structural integrity of the container.

The dust flaps 45, 46 include diagonal score lines 51, 52 which extend outwardly from the corner intersection of the end panel 40 and the top and side panels. The dust flaps also define outwardly extending projections 85, 86 which lie alongside the end panel. The score lines 51, 52 allow the dust flaps to fold when the end panel is closed, and the projections 85, 86 provide vertical support when the container is erected and closed, in a manner described in detail below.

The present invention provides an improved tuck-in closure which resists tearing of the end of the tray formed when the top of the container is removed. The end panel 40 includes a dividing score line 90 extending parallel to the score line 41 joining the top panel 12 to the end panel 40. The score line 90 is preferably spaced from the score line 41 to the level where the connections 47, 48 become the perforated scores 49,50, and terminates at both ends at locations spaced inwardly from the scores 49, 50 by a distance slightly greater than the longitudinal distance from the scores 49, 50 to the diagonal score lines 51, 52.

A pair of diagonal slits 91, 92 are provided in the end panel 40 comprising cut lines extending inwardly from each free side edge of the end panel toward the dividing score 90, as shown in FIG. 1. When the diagonal slits 91, 92 reach the level of the dividing score 90, they curve outwardly toward the tuck flap 42, defining curved end portions 95, 96. The dividing score and diagonal slits play a part in the closing of the tuck-in closure as described below in connection with FIGS. 7–10.

An alternative to the dividing score and diagonal slits is shown in FIG. 11. In this embodiment, a cotainer 100 includes an end panel 102 which includes a pair of transverse slits 105, 106 spaced inwardly from respective side edges of the end panel.

A tear-away portion 60 is defined in the top panel 12 and front side wall 15, as may be seen in FIG. 2. The tear-away portion 60 is partially defined in the blank of FIG. 1 by a score line or zipper score comprising a plurality of spaced-apart cuts. In the preferred embodiment, a zipper score line 61 is provided between the top panel 12 and the end wall flap 40 to define one edge of the tear-away portion. A second zipper score 62 is defined along a portion of the longitudinal score line 34 at the juncture between the top panel 12 and the end flap 32. Note in FIG. 1 that the zipper score 62 is provided only along a portion of the juncture between the top panel 12 and the end flap 32, leaving another portion 63 of the longitudinal score line 34 fully connected and merely creased.

Both the zipper scores 61, 62 are defined by a plurality of spaced-apart cuts in the container material which define a plurality of container material bridges 64 (FIG. 6) between the tear-away portion 60 of the top panel and the remainder of the container. The blank 10 is preferably oriented with the grain of the paperboard running longitudinally, that is, along the line of tearing of scores 61 and 62, so that the bridges 64 are operative to twist without delamination when the container is folded along the zipper scores 61, 62 in the flattened configuration. The zipper scores are further operative to permit controlled delamination along the line defined by the scores when the tear-away portion of the top panel is removed.

More particularly, the spaced-apart cuts of the zipper scores 61, 62 are generally Z-shaped, as shown in FIG. 6. Each of the Z-shaped cuts includes a center line 65 oriented angularly with respect to the line of tearing (shown as a dashed line) of the zipper score 61. A pair of generally parallel cut lines 66, 67 extend in opposite directions from the ends of the center cut line 65 generally along the direction of the zipper score line 61. Each one of the parallel cut lines 66, 67 overlaps an adjacent one of the parallel cut lines of the adjacent Z-shaped cut, as shown at 68, such that a line drawn normal to the end of one of the parallel cut lines intersects the adjacent one of the parallel cut lines of the adjacent Z-shaped cut.

Figure 3:
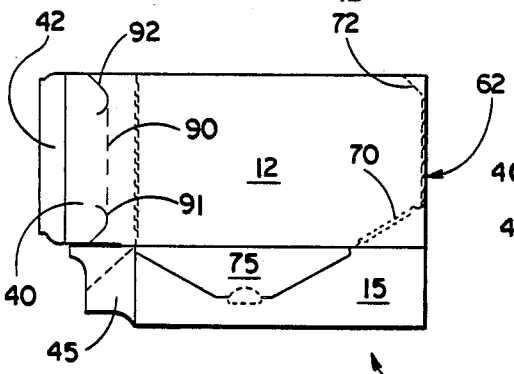
FIG. 3 is a top view of the container shown in FIG. 2 in the flattened configuration.
Figure 4:
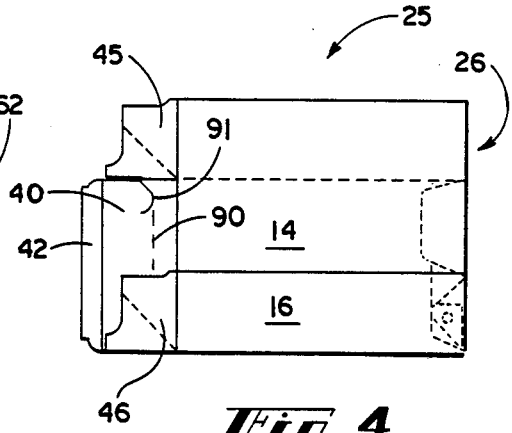
FIG. 4 is a bottom view of the container shown in FIG. 2 in the flattened configuration.

The particular Z-shaped cuts allow twisting of the container material bridges 64 between parallel cut lines of adjacent cuts when the container is folded. In particular, when the container is folded in the flattened configuration such as shown in FIGS. 3 and 4, the zipper score 62 is caused to fold 180 degrees. With the particular Z-shaped cuts disclosed herein, the container material does not delaminate when folded, but advantageously twists in the container material bridge 64 as the edge at the automatic end closure is folded inwardly to flatten the containers.

After the container is erected, and the tear-away portion 60 is to be removed, the zipper scores 61, 62 permit controlled delamination along the line of the zipper scores. Thus, upon removal of the tear-away portion, if the paperboard tends to tear transversely from the end of one of the parallel cut lines 66, 67, the tear will meet an adjacent one of the parallel cut lines of the adjacent Z-shaped cut and be directed along the adjacent cut. Accordingly, the zipper score 61, 62 remain strong enough to hold the carton together during shipment, and then tear away easily when the container is converted into a tray. Since the lines of the zipper scores 61, 62 are aligned with the grain of the paperboard, because of the construction of the zipper scores, the folding along the scores causes twisting of the paperboard fibers without tearing them.

At the juncture between the top panel 12 and the end flap 32 of the automatic end closure, a conventional tear-away score 70 extends from the end of the zipper score 62 diagonally across the corner of the top panel 12, creating a reinforcing connecting web 71. The connecting web 71 is left in place because in the automatic end closure, the end flaps 31 and 32 are not glued together but are held in position by the interlocking of flaps 30 and 32. Thus, the connecting web 71 joins the interlocking automatic end closure to the front side wall 15, and maintains the structural integrity of the container when the top is torn away.

At the end of the zipper score 62 opposite the connecting web 71, a short jump-cut score 72 runs diagonally across the corner of the top panel 12 so that the machining of the blank does not have to extend entirely into the corner. At this corner of the completed container, the end flaps 32 and 33 are glued together.

The transverse score line 21 defines another edge of the tear-away portion 60. Because the tear-away portion is torn away along this score 21 after the zipper score lines 61, 62 have been torn, much better leverage is obtained in removing the tear-away portion and the score 21 does not need to tear away as easily as the zipper scores 61, 62. Accordingly, a fine jump-cut is preferable and gives adequate structural strength to the erected container.

Still further defining the tear-away portion 60 is a panel 75 of the front side wall 15 which remains integrally connected along the transverse score line 20 to the top panel 12, when removed, defines a substantially V-shaped opening which is relatively wide for accessing product in the container near the top panel, and a relatively narrow opening toward the bottom panel for inserting a finger to grasp the panel 75 for removal.

In FIG. 1, the removed panel 75 of the front side wall 15 is defined by reverse-cut scorings 76, 77 placed in a V-shape in the front side wall 15. Those skilled in the art will understand that a reverse cut comprises a cut part way into the paperboard from opposite sides of the paperboard along parallel spaced-apart lines, whereby controlled delamination of the paperboard occurs when the panel is grasped and pulled outwardly. This type of tear-away scoring is used to provide strength prior to opening.

At the upper end of the reverse cut tearaway scorings 76, 77, a pair of short, almost full cut tear-away scorings 78, 79 are provided to easily tear away. At the lower end of the reverse cut scorings 76, 77, a punch-out tab 81 is provided. The tab 81 is connected on both sides to the scorings 76, 77 by full cuts 82 and 82, respectively. The tab 81 can be pushed inwardly, permitting insertion of a finger to grasp the panel 75 for removal.

It will now be appreciated that the tear-away portion 60 in the preferred embodiment extends between the zipper scores 61, 62 across the entire top panel 12, to both of the end closures of the erected container. Accordingly, there is provided convenient access to the product carried within the container and easy removal of the product from the open tray defined after removal of the tear-away portion 60, as illustrated in FIG. 5.

In order to assemble the container, the flaps of the automatic end closure are folded against the top, bottom and side walls in a conventional manner. The glue spots 35 are applied, and glue is applied to the glue flap 22. The bottom panel 14 is folded about transverse score line 19, and then the side wall 16 is folded about transverse score 21 to connect the bottom and side panels and to complete the automatic end closure. The container will then assume the flattened configuration shown in FIGS. 3 and 4. Advantageously, the empty and flattened containers may be shipped to an intermediate user such as a product manufacturer for loading product in the container.

When such a user desires to erect the container for loading product, pressure is simply applied inwardly to the folded scores, which will cause the end flaps 30–33 of the automatic end closure to slide past one another and lock themselves together in a well known manner. The erected configuration is illustrated in FIG. 2. Product can then be inserted into the container through the end opposite the automatic end closure.

The procedure for closing the tuck-in closure after product insertion is illustrated in FIGS. 7–10. First, the end panel 40 is folded about the score 61 to the position shown in FIG. 7. At the same time, the dust flaps 45, 46 are folded outwardly and divided along diagonal scores 51, 52. Next, as shown in FIG. 8, the portion of the end panel 40 below the dividing score 90 and diagonal slits 91, 92 is folded up about the dividing score 90. Then, as shown in FIG. 9, the folded dust flaps are folded in about the scores 47, 48, to a position across the end of the container. It will be seen that the length and diagonal configuration of the slits 91, 92 accommodate the inward folding of the dust flaps. Finally, the portion of the end panel previously folded up is folded down over the dust flaps and the tuck flap 42 is inserted between the bottom panel 14 and the projections 85, 86, which frictionally retain the flap 42.

The final closed configuration is shown in FIG. 10. The curved shape of the slits 91, 92 accommodates the double thickness of the folded dust flaps 45, 46, and thereby prevents any tearing along the dividing score 90. As a result of passing the dust flaps through slits in the end panel, the upper corners of the container are reinforced by the dust flaps lying outside the end panel. Outward force on the end panel is resisted by the dust flaps and directed away from the corners where the connections 47, 48 join the end panel to the side panels. When the top panel 12 has been removed as described below, a user may exert outward force on the end panel 40 when removing product from the container. Such force tends to cause the end panel to bend out along the dividing score 90. The hinging action of the end panel together with the presence of the dust flaps outside a portion of the end panel tends to redirect the exerted outward force from the upper corners to an inward force at a lower point. Thus, the construction of the present invention tends to reduce tearing of the end closure by requiring a greater force to accomplish any tearing.

An alternative to the dividing score and diagonal slits is shown in FIG. 11. In this embodiment, a container 100 includes an end panel 102 which includes a pair of transverse slits 105, 106 spaced inwardly from respective side edges of the end panel. To close the end closure shown in FIG. 11, the end panel 102 is folded down and the dust flaps 45, 46 are folded out in a manner similar to that shown in FIG. 7. However, the tuck flap 42 is inserted. Then the projecting ends of the triangular folded dust flaps are snapped into the slits 105, 106. Preferably, the slits 105, 106 are positioned inwardly from the sides of the end panel a sufficient distance to receive enough of the dust flaps to securely retain them, while being close enough to the ends of the dust flaps to permit convenient insertion.

After closure, the filled containers may then be shipped carrying product without fear of premature separation along any of the perforated score lines.

In order to remove product from the container for dispensing, especially for removing one of a stack of products carried in the container, the end user inserts a finger into the opening defined by the full cuts 81–83, grasps the panel 75 of the front side wall 15, and pulls outwardly. The panel 75 will delaminate along the reverse-scorings 76, 77 and the pair of almost-full cut scorings 78, 79. An upward continuing pull will separate the portion 60 across the conventional tear-away score 70, and along the zipper scores 61, 62. A transverse and upward pull along the transverse jump-cut score line 21 tears the tear-away portion away from the container, exposing the product carried in the container. The container than assumes an open tray as illustrated in FIG. 5.

It will be seen that when the tear-away portion 60 has been removed, the structural integrity of the container is maintained by the connecting webs or dust flaps 45, 46, which maintain the end wall flap 40 connected to the front and rear side walls of the container and by the connecting web 71, which maintains the connection between the front side wall 15 and the automatic end closure 26. Thus, product can be kept in the open-top container tray and still be retained and protected by the walls of the container.

The disclosure of our prior application Ser. No. 558,030, filed Dec. 5, 1983, now U.S. Pat. No. 4,550,834, is expressly incorporated herein by reference in its entirety.

While this invention has been described in detail with regard to a preferred embodiment thereof, it should be understood that variations and modifications can be made without departing from the spirit and scope of the invention as defined in the following claims.

We claim:

1. A sleeve-like container of paperboard or the like comprising:

a top panel;

a bottom panel;

first and second side panels connecting said top and bottom panels;

an end panel foldably connected to said top panel along a fold line having two termination points;

a tuck flap foldably connected to said end panel opposite said top panel, a pair of webs extending between said end panel and each of said side panels, each of said webs including a diagonal score line extending from one of said termination points for folding said web, said webs ending prior to said tuck flap, leaving free edges of said end panel; and a cut line in said end panel for receiving said folded webs when said end panel is closed, said cut line extending from each free edge of said end panel into said end panel to a location beyond said diagonal score line when said folded webs are folded into the plane of said panel.

2. The container of claim 1, wherein said end panel includes a dividing score line parallel to the foldable connection of said end panel to said top panel; and wherein each said cut line extends, from a point on the free edge of said end panel between said dividing score line and said tuck flap, diagonally to meet said dividing score line.

3. The container of claim 2, wherein said dividing fold line terminates at its intersection with each of said cut lines.

4. The container of claim 3, wherein each of said cut lines, after meeting said dividing score line, curves back toward said tuck flap.

5. The container of claim 4, further comprising tear score means cut along the foldable connections between said top panel and said end and side panels for enabling removal of said top panel from said end and side panels.

6. A cut and scored blank of paperboard or like material for forming a sleeve-like container, comprising:

a top panel;

first and second side panels foldably connected to said top panel;

a bottom panel foldably connected to said first side panel opposite said top panel;

an end panel foldably connected to one of said top and bottom panels along a fold line having two intersection points;

a pair of webs of said material extending between said end panel and each of said side panels, each of said webs including a diagonal score line extending from one of said termination points for folding said webs;

a cut line in said end panel for receiving said folded webs when said container is erected and said end panel is closed; and a tuck flap foldably connected to said end panel opposite said one of said top and bottom panels, wherein said webs end prior to said tuck flap, leaving free edges of said end panel, and wherein said cut line extends from each free edge of said end panel to a location beyond said diagonal score line when said folded webs are folded into the plane of said end panel.

7. The container of claim 6, wherein said end panel includes a dividing score line parallel to the foldable connection of said end panel to said top panel; and wherein each said cut line extends, from a point on the free edge of said end panel between said dividing score line and said tuck flap, diagonally to meet said dividing score line.

8. The container of claim 7, wherein said dividing fold line terminates at its intersection with each of said cut lines.

9. The container of claim 8, wherein each of said cut lines, after meeting said dividing score line, curves back toward said tuck flap.

10. The container of claim 9, further comprising tear score means cut along the foldable connections between said top panel and said end and side panels for enabling removal of said top panel from said end and side panels.

* * * * *